US005415444A

United States Patent [19]

Hull et al.

[11] Patent Number: 5,415,444

[45] Date of Patent: May 16, 1995

[54] PORTABLE DOOR LOCK

[76] Inventors: Harold L. Hull, 401 Canyon Way #43, Sparks, Nev. 89434; Jeff D. Lewis, 66 S. Wells, Reno, Nev. 89502

[21] Appl. No.: 112,948

[22] Filed: Aug. 30, 1993

[51] Int. Cl.[6] ..... E05C 19/18

[52] U.S. Cl. ..... 292/288; 292/343; 292/DIG. 15

[58] Field of Search ..... 292/258, 288, 289, 329, 292/150, 292, 295, 343, 355, 268, 269, 264, 342, DIG. 15, DIG. 44, DIG. 46

[56] References Cited

U.S. PATENT DOCUMENTS

| | | | |
|---|---|---|---|
| D. 329,799 | 9/1992 | Conklin | D8/331 |
| 748,543 | 12/1903 | Terry | 292/DIG. 15 |
| 833,024 | 10/1906 | Clark | 292/DIG. 15 |
| 867,811 | 9/1909 | Houser | 292/DIG. 15 |
| 1,112,620 | 10/1914 | Johnson | 292/DIG. 15 |
| 3,124,382 | 6/1962 | Strother | 292/343 |
| 4,326,394 | 4/1982 | Stein | 70/14 |
| 4,330,146 | 5/1982 | Sessions | 292/258 |
| 4,405,165 | 9/1983 | Johns | 292/258 |
| 4,569,546 | 2/1986 | Howard et al. | 292/DIG. 15 |
| 4,653,785 | 3/1987 | Tobey | 292/258 |
| 4,673,203 | 6/1987 | Chezem | 292/339 |

*Primary Examiner*—Peter M. Cuomo
*Assistant Examiner*—Monica E. Millner

[57] ABSTRACT

A device or structure for temporarily securing a door, which the occupant of a room (such as a motel or hotel room) can affix to secure the door from being opened from the outside, while the occupant is in the room. The apparatus may be carried in a briefcase or suitcase, it requires no modifications of the door or door frame, it does not mar any surfaces, it may be installed or removed quickly by the occupant and is economical to build.

10 Claims, 3 Drawing Sheets

FIG 3
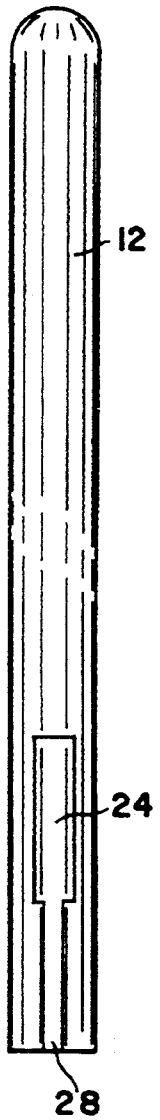
FIG 4
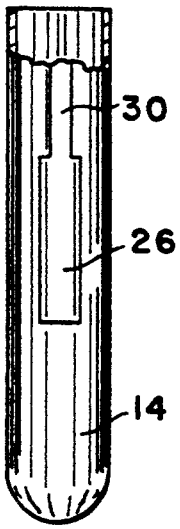
FIG 5
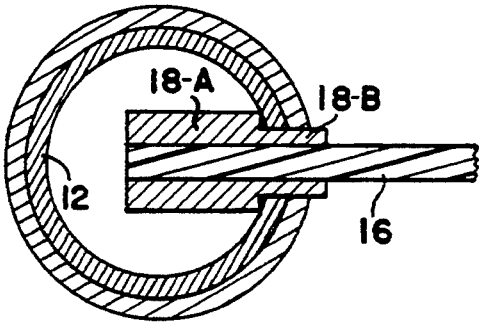
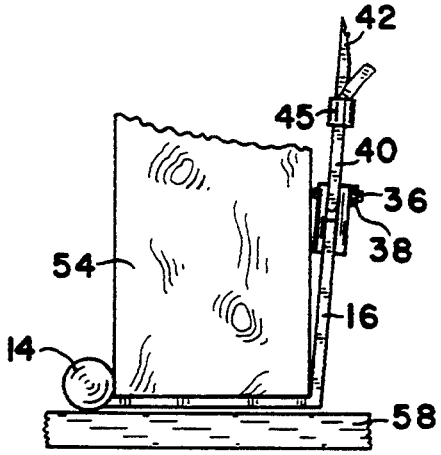
FIG 6

PORTABLE DOOR LOCK

FIELD OF THE INVENTION

This invention relates to door locks and more particularly to a door lock for use inside a room while the room is being occupied.

BACKGROUND OF THE INVENTION

In the past, a number of portable door locks have been taught which can be attached to any hinged type door to secure it against un-authorized opening. However, most of them require some modification of the door jam, such as a hole or bore in the jam or the use of a pad-lock and key, such as taught by U.S. Pat. No. 4,653,785, or the apparatus of U.S. Pat. No. 4,955,648 which teaches a security device for preventing opening of a hinged door from the inward swinging side.

While such devices are complete within themselves and are sufficient for their intended use, the present invention has features and objects heretofore un-taught and which the inventors consider the invention.

SUMMARY OF THE INVENTION

It is therefore a primary object to provide a temporary door lock which may be installed from the inside of a room such as a hotel or motel room to provide added security.

It is a further object to provide a door lock which may be installed or removed quickly.

It is another object to provide a door lock which is portable and which may be carried in a briefcase or the like.

It is still another object to provide a door lock which operates without any modification of the door or door jam.

Yet another object is to provide a door lock which does not mar the finish of the door or door jam.

Still another object is to provide a door lock which covers up any part which might be easily cut from the outside of the door.

BRIEF DESCRIPTION OF THE DRAWINGS

FIG. 3 is a side view of one of the components.

FIG. 4 is a side view of a second component.

FIG. 5 is a section taken at 5—5 of FIG. 2.

FIG. 6 is a plan view similar to FIG. 1, but showing only the bottom section of the door and top of the floor.

DETAILED DESCRIPTION OF THE DRAWINGS

Figure 1:
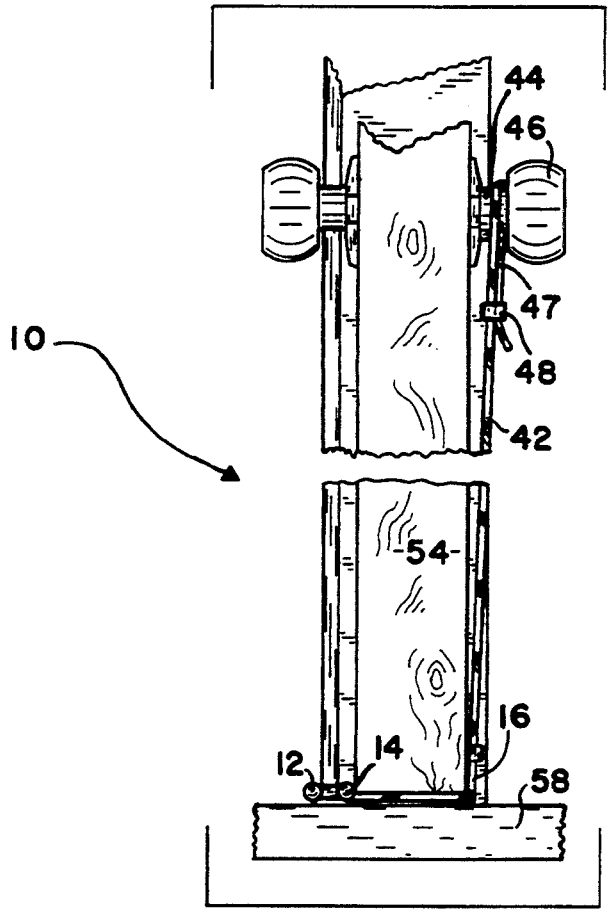
FIG. 1 is a plan view of the door lock of the present invention attached to a typical inward swinging hotel door.

Referring now in detail to the drawings wherein like characters refer to like elements throughout the various drawings, 10 is a plan view in elevation showing our new door lock installed on a typical door 54 with 12 being an outer tubular bar element which has a working relationship with its counterpart tubular bar 14, with the two parts 12 and 14 , respectively, having an inner locking relationship more clearly shown in FIGS. 3, 4 and 5, respectively, with 16 being a flexible strap which is made of metal or plastic with a first end 18-A and 18-B and a second end 20, more clearly shown in FIGS. 7, 8, 9 and 10, respectively, ends 18-A, 18-B and 20, respectively, being made of a material such as metal or plastic and affixed to their respective ends by a suitable means such as rivets or pins 22.

Figure 2:
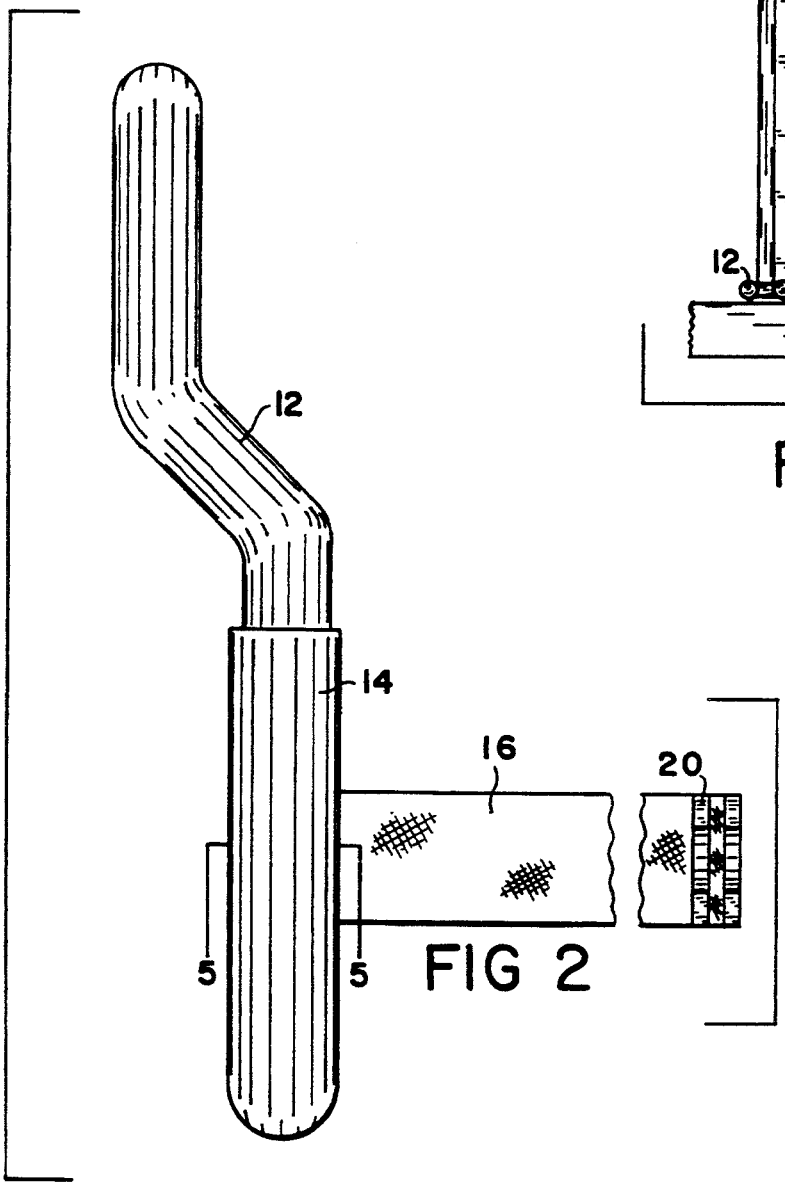
FIG. 2 is a top view of the assembled lock.

Referring now to FIGS. 3 and 4, respectively, FIG. 3 is a side view of element 12, in FIG. 2, element 12 is shown turned 90 degrees on its axis, with 24 being a slot to accept the smaller section 18-B of the first end 18-A and 18-B. Slots 28 and 30, respectively, are slots to allow the strap 16 to slide through to allow the end 18-A and 18-B to be inserted into slots 24 and 26, respectively, thus locking the two elements 12 and 14 together internally.

Figure 7:
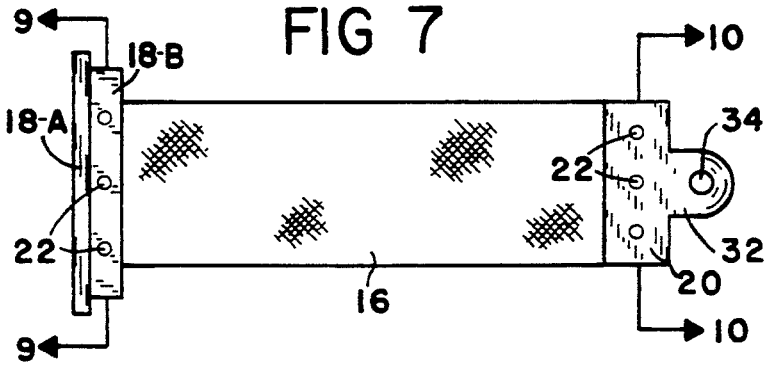
FIG. 7 is a top view of a third component.
Figure 8:
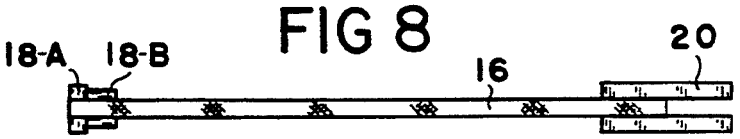
FIG. 8 is a side view of FIG. 7.
Figure 9:
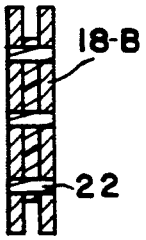
FIG. 9 is a section taken at 9—9 of FIG. 7.
Figure 10:
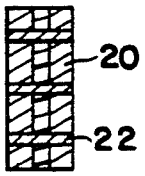
FIG. 10 is a section taken at 10—10 of FIG. 7.
Figure 11:
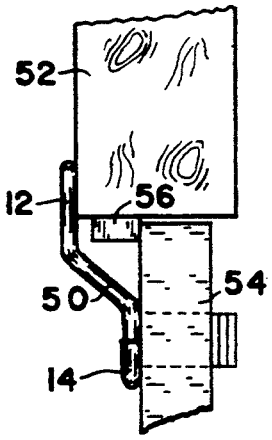
FIG. 11 is a schematic showing the components in place beneath a typical door.

Referring now to FIGS. 7 and 8 respectively, the second end 20 of strap 16, has a boss 32 having a bore 34 to accept bolt 36 with nut 38, as shown more clearly in FIG. 6, bolt 36 being encircled by first loop 40 of rope or cable 42, loop 40 being held by clamp 45 and rope 42 on its upper end having a second loop 47 which encircles the base 44 of door knob 46 and is held in place by adjustable means such as clamp 48.

It will now be noted that element 12 may have an offset or bend 50 to allow it to be positioned on the outside of the wall 52 as shown in partial plan view 11, with 54 being a door and 56 being a door jam.

It will also be noted that element 14, more clearly shown in partial plan view 6, when positioned against the door 54 and above the floor 58 at its bottom, covers the first end 18-A and 18-B of strap 16 in such a manner that the strap 16 cannot be reached by a cutting tool such as a knife or the like.

It will now be noted that when the portable door lock of the present invention is assembled and the strap 16 slipped under the door, that when the strap is moved toward the center of the door that element 12 will clear the door jam and wall and after the door is closed the strap with element 12 and 14 may be slipped to a position towards the opening edge of the door to allow element 12 to be located outside the wall adjacent the door edge and then the rope or cable 40 is pulled tight and the loop 47 affixed over the base 44 of the door knob 46 and held in a tightened position by adjustable clamp 48.

It will also be noted that the strap 16 grips the bottom of the door 54 and element 14 is in a firm position between the door 54 and floor 58 further helping to secure the apparatus in a locked position.

It will also be noted that the door lock of the present invention may be installed from the inside of a room such as a hotel or motel room and may be installed or removed quickly, is portable, may be carried in a briefcase or the like, requires no modification of the door or door jam, does not damage or mar the door and is not readily removable from the outside, thus providing additional added security.

Although the invention has been shown and described in what is conceived to be the most practical and preferred embodiment, it is recognized that departures may be made therefrom within the scope and spirit of the invention, which is not to be limited to the details disclosed herein but is to be accorded the full scope of the claims so as to embrace any and all equivalent devices and apparatus's.

Having described our invention, what we claim as new and desire to secure by letters patent is:

1. A portable door lock for preventing opening of a hinged door from its outward swinging side having a door knob and a door knob base comprising: a first and second substantially elongated tubular member; said first tubular member having first and second end sections and a center section, said first and second end sections being substantially parallel, said center section being at an angle to said first and second end sections and joining said first and second end sections together to form a continuous member, said second end of said first member being an open second end, said second section of said first substantially elongated tubular member having an elongated slot communicating from said open second end with a second substantially rectangular slot located lengthwise in substantially a center portion of said second end section; said second substantially elongated tubular member having a first and second end, said first end being an open first end, said second member having an interior circumference large enough to accept said second end section of said first member in a telescopic relationship, said second member having an elongated slot communicating from said open first end with a second substantially rectangular slot located lengthwise in substantially a center portion of said second member, a flexible strap member; said strap member having a first and second end, said strap member having a first substantially rectangular member affixed to its said first end, said first rectangular member having a substantially rectangular section of a size and shape to enter said second rectangular slot of said first and second tubular member to lock said first and second tubular member together, said first rectangular member having a lip to prevent said first rectangular member from exiting said rectangular slot, said strap member having a second substantially rectangular member affixed to said second end, an elongated flexible member; said flexible member having a first end and a distal end, means to affix said first end of said flexible member to said second rectangular member, means to adjustably affix said distal end of said flexible member to said base of said door knob, whereby;

when said first and second tubular members are in register and locked together by said first rectangular member affixed to said first end of said strap and said strap is positioned underneath said door, said first tubular member engages a portion of a wall structure to which an opening edge of said door closes against and said distal end of said elongated flexible member is adjustably affixed to said base of said door knob, said door is prevented from being opened from said outward swinging side.

2. The door lock of claim 1, in which said first and second tubular members are made of steel tubing.

3. The door lock of claim 1, in which said first end of said first member is closed.

4. The door lock of claim 1, in which said strap is made of a woven metal.

5. The door lock of claim 1 in which said strap and said first and said rectangular members affixed to said first and second ends of said strap are made of plastic.

6. The door lock of claim 1, in which said first and second substantially rectangular members affixed to said first and second ends of said strap is by means of multiple pins.

7. The door lock of claim 1, in which said elongated flexible member is a rope.

8. The door lock of claim 1, in which said elongated flexible member is a stranded metal cable.

9. The door lock of claim 1, in which said means to affix said first end of said flexible member to said second rectangular member to said base of said door knob is by forming a loop in said distal end, said loop having clamping means and a bolt, said loop being of a size and shape to surround and capture said bolt and said bolt being of a size and shape to be inserted into a bore on said second rectangular member.

10. The door lock of claim 1, in which said means to adjustably affix said distal end of said flexible member to said base of said door knob is by said distal end being formed into a loop and said loop having an adjustable clamp attached thereto.

* * * * *